US006123604A

United States Patent [19]

Mizuno et al.

[11] Patent Number: 6,123,604

[45] Date of Patent: Sep. 26, 2000

[54] APPARATUS AND METHOD FOR GRINDING EYEGLASS LENSES

[75] Inventors: Toshiaki Mizuno; Ryoji Shibata; Hirokatsu Obayashi, all of Aichi, Japan

[73] Assignee: Nidek Co., Ltd., Aichi, Japan

[21] Appl. No.: 08/961,945

[22] Filed: Oct. 31, 1997

[30] Foreign Application Priority Data

Oct. 31, 1996 [JP] Japan ..... 8-307182

[51] Int. Cl.[7] ..... B24B 1/00

[52] U.S. Cl. ..... 451/42; 451/5

[58] Field of Search ..... 451/5, 6, 42, 43, 451/44, 255, 256

[56] References Cited

U.S. PATENT DOCUMENTS

| | | | |
|---|---|---|---|
| 5,138,770 | 8/1992 | Matsuyama . | |
| 5,321,915 | 6/1994 | Lecerf et al. | 451/6 |
| 5,333,412 | 8/1994 | Matsuyama . | |
| 5,347,762 | 9/1994 | Shibata et al. . | |
| 5,353,551 | 10/1994 | Nishida | 451/6 |
| 5,371,974 | 12/1994 | Lecerf et al. | 451/5 |
| 5,562,523 | 10/1996 | Asano et al. | 451/5 |
| 5,588,899 | 12/1996 | Gottschald | 451/6 |
| 5,630,746 | 5/1997 | Gottschald et al. | 451/5 |
| 5,727,987 | 3/1998 | Gottschald | 451/5 |

FOREIGN PATENT DOCUMENTS

| | | | |
|---|---|---|---|
| 0 444 902 A2 | 9/1991 | European Pat. Off. . | |
| 0 734 811 A2 | 10/1996 | European Pat. Off. . | |
| 0 803 325 A2 | 10/1997 | European Pat. Off. . | |
| 4115372 | 2/1992 | Germany | 451/1 |
| 7-44440 | 10/1995 | Japan . | |

*Primary Examiner*—David A. Scherbel
*Assistant Examiner*—Daniel G. Shanley
*Attorney, Agent, or Firm*—Sughrue, Mion, Zinn, Macpeak & Seas, PLLC

[57] ABSTRACT

An eyeglass lens grinding machine, which is designed to effectively utilize the grinding capability of abrasive wheels so as to perform efficient grinding operations. The eyeglass lens grinding machine includes a lens rotating section which holds and rotates a lens to be processed, an abrasive wheel rotating section which rotates an abrasive wheel for grinding the lens on its own axis, an abrasive wheel's rotational state detecting section which detects the state of rotation of the abrasive wheel caused by the abrasive wheel rotating section, and a rotation control section which variably changes the rotation of the lens rotating section on the basis of the result of the detection. The rotation control section issues a command to either stop or slow down the rotation of the lens if the load on the rotation of the abrasive wheel exceeds a predetermined reference level and issues a command to have the lens rotation return to the initial state if the load becomes lower than the reference level.

8 Claims, 6 Drawing Sheets

APPARATUS AND METHOD FOR GRINDING EYEGLASS LENSES

BACKGROUND OF THE INVENTION

The present invention relates to an apparatus and a method for grinding the periphery of an eyeglass lens to fit into an eyeglass frame.

An eyeglass lens grinding machine is known and this machine grinds a lens on the basis of the frame configuration data obtained by tracing (profiling) an eyeglass frame with a tracer. The machine has lens grinding abrasive wheels which are driven with a motor to rotate at high speed and a carriage which clamps the lens between rotating shafts and holds it rotatably. With the lens being revolved, the carriage is rotationally moved on the basis of the frame configuration data such that the distance between the axis of the lens rotating shaft and that of the abrasive wheel rotating shaft is adjusted to permit the grinding of the edge of the lens as it is brought in contact with the abrasive wheel. During the grinding operation, the carriage is rotationally moved such that the grinding pressure on the abrasive wheel is maintained constant by a spring force or the like whereas the required grinding load is exerted between the lens and the abrasive wheel by the rotation of both. The force to rotate the abrasive wheel is transmitted from the associated motor via a belt.

A problem with the conventional eyeglass lens grinding machine is that if with a view to enhancing the grinding efficiency, a high-performance abrasive wheel having great cutting power is employed or a higher rotational speed is adopted, the rotational load increases so much that the abrasive wheel will occasionally stop revolving. If the abrasive wheel stops rotating, an abnormal electric current will flow through the motor to increase the chance of the occurrence of thermal damage or other troubles. In addition, the increased rotational load has often affected the precision of lens processing. To deal with this situation, it has been necessary to perform the intended operation with the rotational speeds of the lens and the abrasive wheel being appropriately set by taking into account the highest grinding load that will be exerted during the processing operation; however, this eventually results in a failure to utilize the potential grinding capabilities of the above-described approaches to the fullest extent.

SUMMARY OF THE INVENTION

The present invention has been accomplished under these circumstances and has as an object providing an eyeglass lens grinding machine which utilizes the grinding capability of the abrasive wheel to such an extent that the intended grinding operation can be performed with high efficiency.

Another object of the invention is to provide a method capable of such satisfactory grinding operation.

The stated objects of the invention can be attained by the following.

1. An eyeglass lens grinding machine comprising lens rotating means for holding and rotating a lens to be processed, abrasive wheel rotating means for rotating an abrasive wheel for grinding the Lens on its own axis, abrasive wheel's rotational state detecting means for detecting a state of rotation of the abrasive wheel caused by said abrasive wheel rotating means, and rotation control means for variably changing the rotation of said lens rotating means on the basis of the result detected by said abrasive wheel's rotational state detecting means.

2. The eyeglass lens grinding machine of 1, wherein said abrasive wheel's rotational state detecting means has photodetector means for projecting light onto the rotating abrasive wheel or its shaft and for detecting reflected light therefrom.

3. The eyeglass lens grinding machine of 1, wherein said abrasive wheel's rotational state detecting means includes load detecting means for detecting a grinding load, and wherein said rotation control means includes command means for issuing a command to either stop or slow down the rotation of said lens rotating means if the load detected by said load detecting means exceeds a given reference value, and return command means for issuing a command to revert the rotation of said lens rotating means to a steady state if said load is less than the given reference value.

4. The eyeglass lens grinding machine of 3, further comprising rotational speed setting means for variably setting a rotational speed of said abrasive wheel rotating means.

5. The eyeglass lens grinding machine of 1, wherein said abrasive wheel's rotational state detecting means includes rotational speed detecting means for detecting the rotational speed of the abrasive wheel or its shaft per unit time, and wherein said rotation control means includes stop command means for issuing a command to stop the rotation of said lens rotating means if the rotational speed of the abrasive wheel has become lower than a given rotational speed which has been preset as relative to a reference rotational speed, and restart command means for issuing a command to restart the rotation of said lens rotating means if the rotational speed of the abrasive wheel has become higher than the given rotational speed.

6. The eyeglass lens grinding machine of 1, wherein said abrasive wheel's rotational state detecting means includes the number of rotations detecting means for detecting the number of rotations of the abrasive wheel or its shaft per unit time, and wherein said rotation control means includes stop command means for issuing a command to stop the rotation of said lens rotating means if the number of rotations of the abrasive wheel has become lower than a given number of rotations which has been preset as relative to a reference number of rotations, and restart command means for issuing a command to restart the rotation of said lens rotating means if the number of rotations of the abrasive wheel has become higher than the given number of rotations.

7. A method for grinding eyeglass lenses, comprising steps of (1) holding and rotating a lens to be processed, (2) rotating an abrasive wheel for grinding the lens on its own axis, (3) detecting a state of rotation of the abrasive wheel, and (4) variably controlling the rotation of the lens on the basis of the detected state of rotation of the abrasive wheel.

8. The method for grinding eyeglass lens of 7, wherein the step (3) includes projecting light onto the rotating abrasive wheel or its shaft, and detecting reflected light therefrom.

9. The method for grinding eyeglass lens of 7, wherein the step (4) includes either stopping or slowing down the rotation of said lens rotating means if the detected state of rotation of the abrasive wheel does not satisfy a predetermined condition, and reverting the rotation of said lens rotating means to a steady state if the detected state of rotation of the abrasive wheel satisfies a predetermined condition again.

10. The method for grinding eyeglass lens of 9, wherein the state of rotation of the abrasive wheel is detected as a grinding load on the abrasive wheel, the number of rotation or the rotational speed of the abrasive wheel or its shaft per unit time.

DETAILED DESCRIPTION OF THE PREFERRED EMBODIMENT

An embodiment of the invention will now be described in detail with reference to the accompanying drawings.

(General Layout of the Machine)

Figure 1:
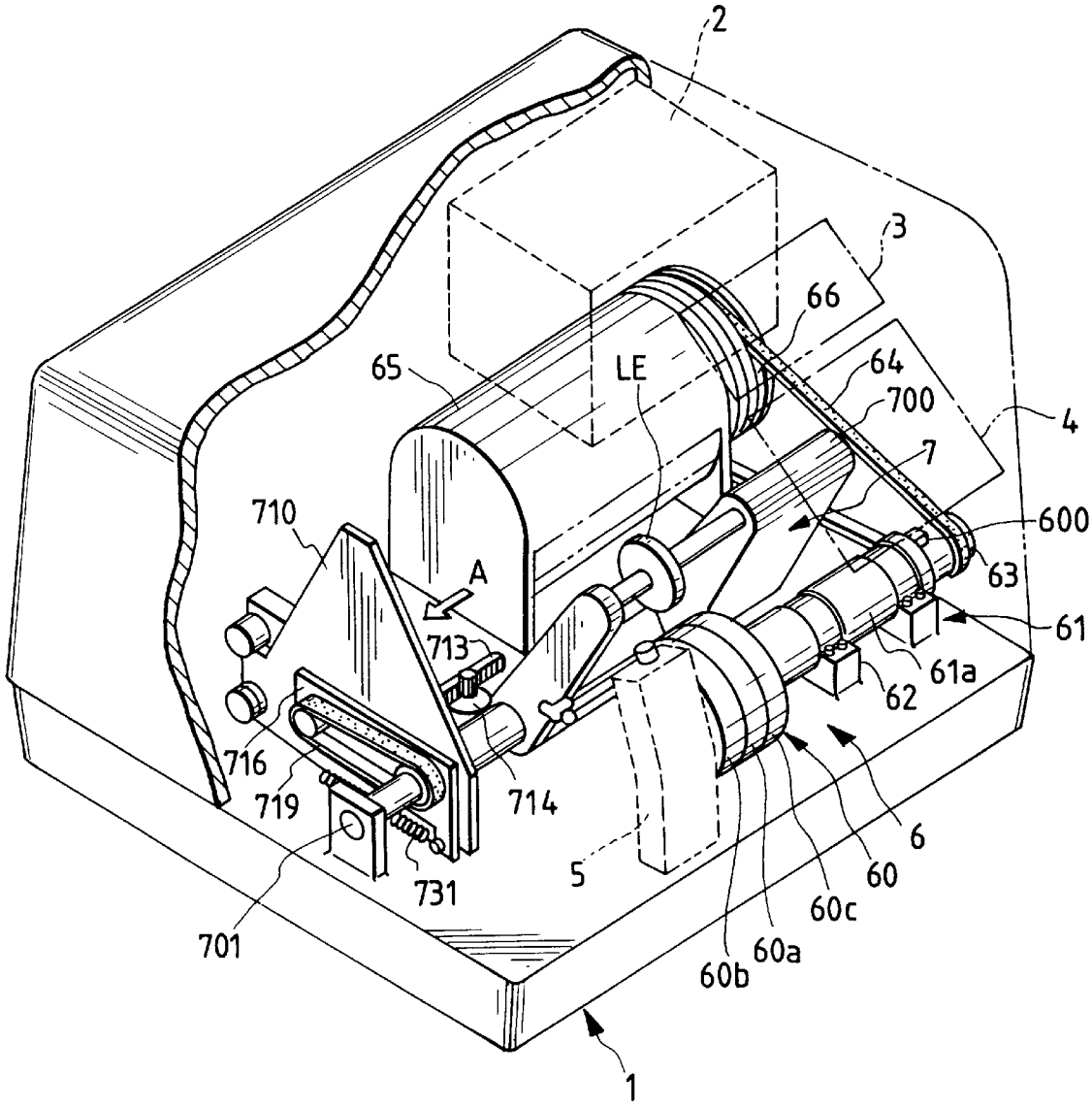
FIG. 1 is a perspective view showing the general layout of the eyeglass lens grinding machine of the invention.

FIG. 1 is a perspective view showing the general layout of the eyeglass lens grinding machine of the invention. The reference numeral 1 designates a machine base, on which the components of the machine are arranged. The numeral 2 designates an eyeglass frame and template configuration measuring device, which is incorporated in the upper section of the grinding machine to obtain three-dimensional configuration data on the geometries of the eyeglass frame and the template (see, for example, commonly assigned U.S. Pat. No. 5,333,412). Arranged in front of the measuring device 2 are a display section 3 which displays the results of measurements, arithmetic operations, etc. in the form of either characters or graphics, and an input section 4 for entering data or feeding commands to the machine. Provided in the front section of the machine is a lens configuration measuring device 5 for measuring the imaginary edge thickness, etc. of an unprocessed lens (see, for example, U.S. Pat. No. 5,347,762).

The reference numeral 6 designates a lens grinding section, where an abrasive wheel group 60 made up of a rough abrasive wheel 60*a* for use on glass lenses, a rough abrasive wheel 60*b* for use on plastic lenses and a finishing abrasive wheel 60*c* for tapered edge (bevel) and plane processing operations is mounted on the rotating shaft 61*a* of a spindle unit 61, which is attached to the machine base 1 by means of fixing bands 62. A pulley 63 is attached to an end of the abrasive wheel rotating shaft 61*a* of the spindle unit 61. The pulley 63 is linked to a pulley 66 via a belt 64, with the pulley 66 being attached to the rotational shaft of an AC motor 65. Accordingly, the rotation of the motor 65 causes the abrasive wheel group 60 to rotate. The spindle unit 61 is also provided with an abrasive wheel rotation detecting section 600 which detects the rotation of the abrasive wheel rotating shaft 61*a*. Shown by 7 is a carriage section and 700 is a carriage.

(Layout of the Major Components)

(A) Carriage Section

Figure 2:
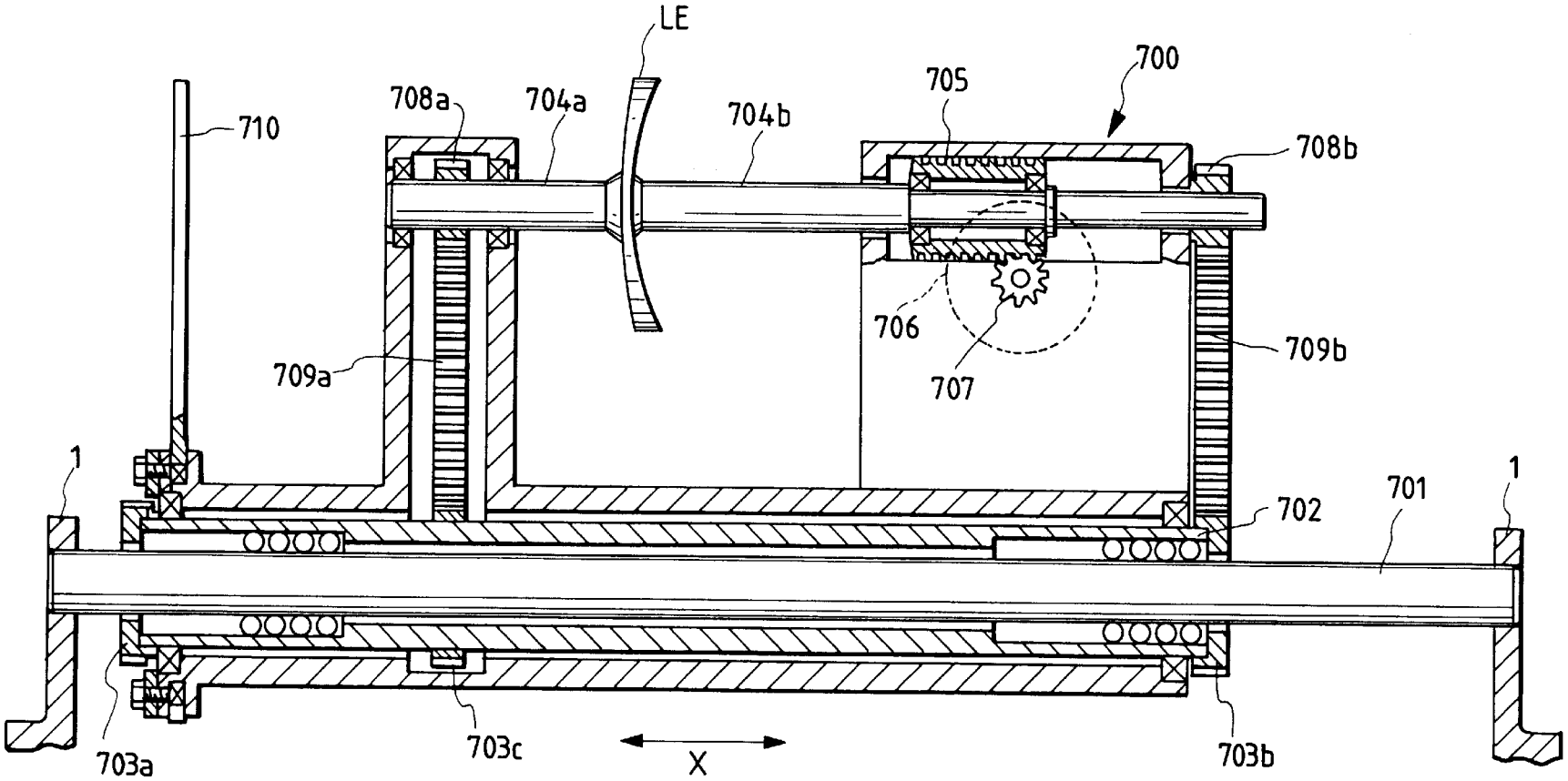
FIG. 2 is a cross-sectional view of the carriage in the grinding machine.
Figure 3:
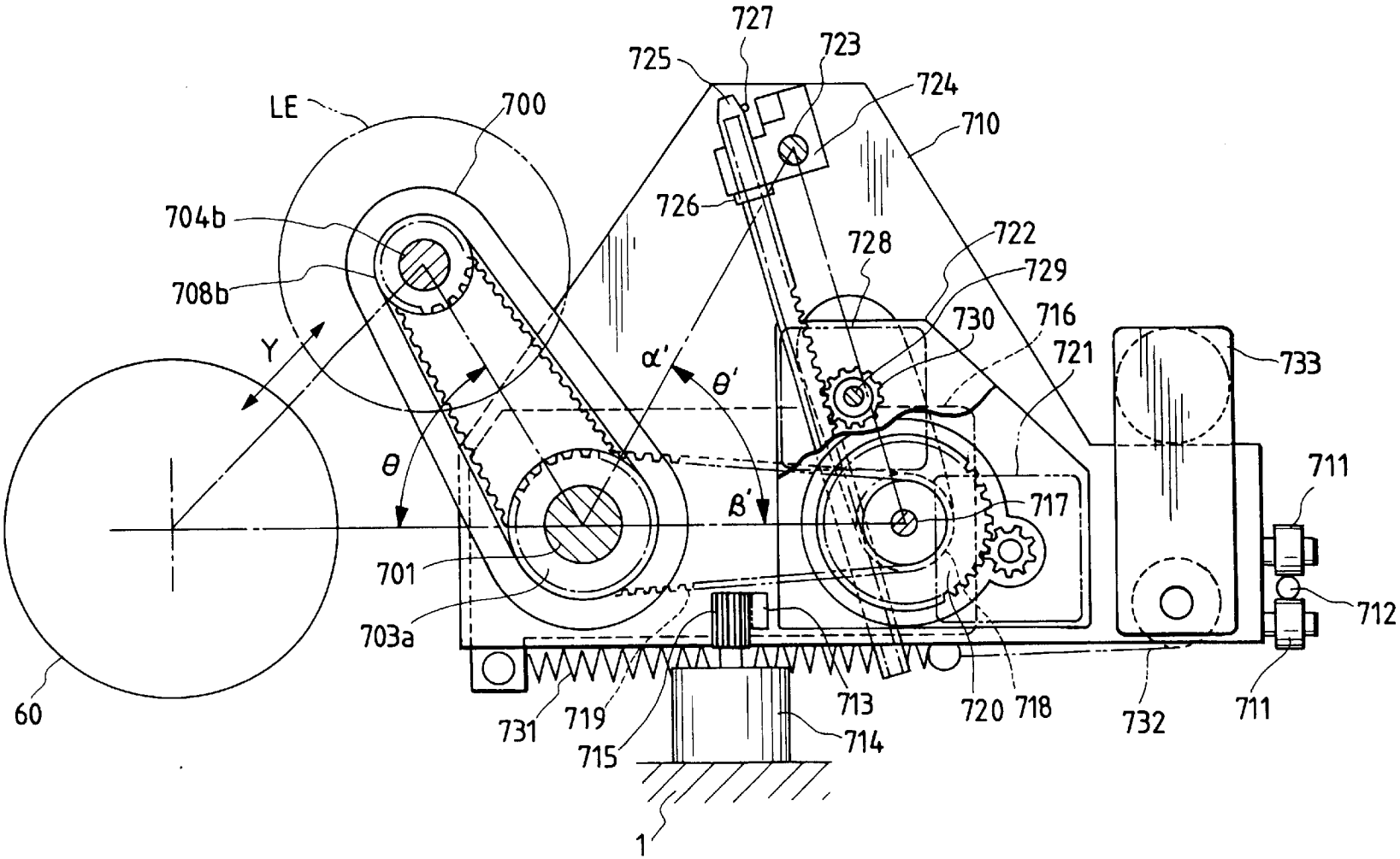
FIG. 3 is a diagram showing a drive mechanism for the carriage, as viewed in the direction of arrow A in FIG. 1.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1. The carriage 700 is so adapted that it not only chucks the workpiece lens LE (i.e. the lens to be processed) for rotation but also adjusts the distance of the lens LE with respect to the abrasive wheel rotating shaft 61*a* and its position in the direction of lens rotating shafts 704*a*, 704*b*. In the following description, the axis extending in the direction for adjustment of the distance between the abrasive wheel rotating shaft 61*a* and each of the lens rotating shafts 704*a*, 704*b* will be referred to as the Y-axis and the axis along which the lens is moved parallel to the abrasive wheel rotating shaft is called the X-axis.

(a: Lens chucking mechanism)

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701 and with the distance therefrom being unchanged. The lens rotating shaft 704*b* is rotatably supported in a rack 705, which is movable in the axial direction by means of a pinion 707 fixed on the rotational shaft of a motor 706; as a result, the lens rotating shaft 704*b* is moved axially such that it is opened or closed with respect to the other lens rotating shaft 704*a*, thereby holding the lens LE in position.

(b: Lens rotating mechanism)

A drive plate 716 is securely fixed at the left end of the carriage 700 and a rotational shaft 717 is rotatably provided on the drive plate 716, extending parallel to the shaft 701. A gear 720 is provided at the right end of the rotational shaft 717 to mesh with a gear attached on a pulse motor 721, which is secured on a block 722 which is rotatably attached to the drive plate 716 in such a way that it is coaxial with the rotational shaft 717. When the pulse motor 721 rotates, a pulley 718 attached at the left end of the rotational shaft 717 rotates and the resulting rotation is transmitted to the shaft 702 via a timing belt 719 and a pulley 703*a*. The rotation of the shaft 702 in turn is transmitted to the lens chucking shafts 704*a* and 704*b* by means of pulleys 703*c* and 703*b* securely fixed on the shaft 702, pulleys 708*a* and 708*b* attached to the lens rotating shafts 704*a* and 704*b*, respectively, and timing belts 709*a* and 709*b* which connect the respective pulleys. Therefore, the rotation of the pulse motor 721 causes the lens chucking shafts 704*a* and 704*b* to rotate in synchronism, (c: Mechanism for movement in the direction of X-axis)

An intermediate plate 710 is rotatably secured at the left end of the carriage 700. The intermediate plate 710 has a rack 713 which meshes with a pinion 715 attached to the rotational shaft of a carriage moving motor 714 secured to the base 1, extending parallel to the shaft 701. Two cam followers 711 are provided on the side of the intermediate plate 710 which is away from the operator such that they clamp a guide shaft 712 secured on the base 1, extending parallel to the shaft 701. With this arrangement, the motor 714 is capable of moving the carriage 700 in the axial direction of the shaft 701 (in the direction of X-axis).

(d: Mechanism for movement in the direction of Y-axis and a mechanism for detecting the end of lens processing)

The Y-axis of the carriage 700 is changed by a pulse motor 728, which is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens chucking shafts 704*a* and 704*b* since r has a linear correlationship with r' (see, for example, U.S. Pat. No. 5,347,762).

A hook of a spring 731 is in engagement with the drive plate 716 secured to the carriage 700 and a wire 732 is in engagement with a hook at the other end of the spring 731. A drum is attached to the rotational shaft of a motor 733 secured on the intermediate plate 710 such that the resilient force of the spring 731 can be adjusted by winding up the wire 732. The carriage 700 is pulled by the spring 731 toward the abrasive wheels such that it continues to move in the direction of Y-axis until the stopper 726 contacts the correction block 724. However, during the lens processing, the carriage 700 is pushed up by the reaction of the abrasive wheels so that the stopper 726 will not contact the correction block 724 until after the end of the necessary processing in the direction of Y-axis which is controlled by the rotation of the pulse motor 728. The contact of the stopper 726 with the correction block 724 is checked by a sensor 727 on the intermediate plate 710 so as to detect the end of lens processing.

(B) Abrasive Wheel Rotation-Detecting Section

Figure 4A:
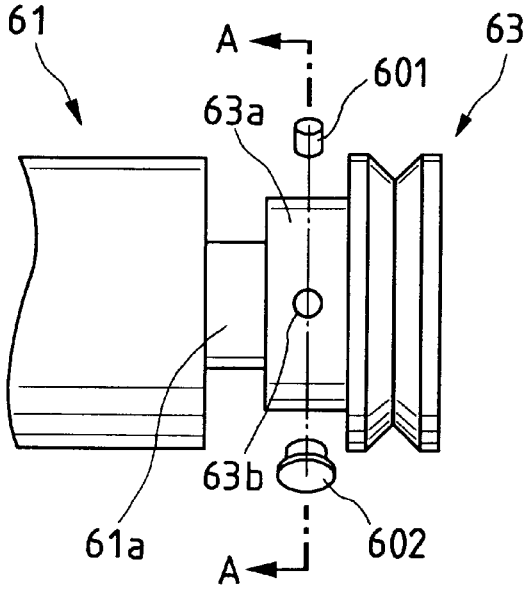
FIGS. 4(*a*) and 4(*b*) illustrate the abrasive wheel rotation detecting section of the grinding machine.
Figure 4B:
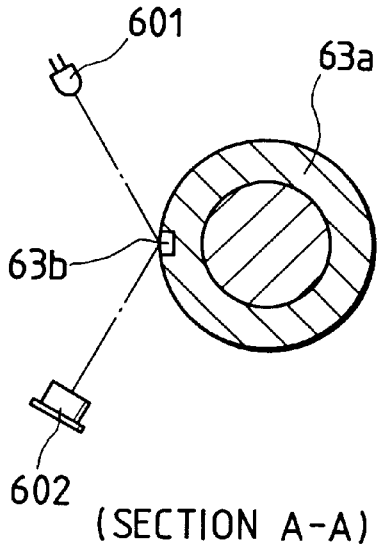

FIGS. 4(*a*) and 4(*b*) illustrate the abrasive wheel rotation detecting section 600. The reference numeral 63*a* designates a shaft mounting portion which is part of the pulley 63 and which has a hole 63*b* formed therein (as the hole 63*b*, one for use in securing the rotating shaft 61*a* to the pulley 63 by means of a fastening screw may be used). Indicated by 601 and 602 are an LED and a photosensor, respectively, and they are attached to the spindle unit 61 by means of securing members (not shown) in such a way that their optical axes cross each other on the surface of the shaft mounting portion 63*a*. Light emitted from the LED 601 is reflected from the surface of the shaft mounting portion 63*a* to be directed toward the photosensor 602. When the pulley 63 is rotated by the AC motor 65 to cause the hole 63*b* to pass across the optical axis of the light received by the photosensor 602, there occurs a sufficient change in the amount of reflected light for the photosensor 602 to detect the state of rotation of the rotating shaft 61*a* (i.e., the state of rotation of the abrasive wheel group 60). If desired, a reflecting member may be wrapped around the shaft mounting portion 63*a* in order to enhance the efficiency of reflected light or the hole 63*b* may be replaced by a mark or the like; these modifications will provide greater ease in detection.

The abrasive wheel rotation detecting section 600 may alternatively be designed to detect the rotation of an end face of the rotating shaft 61*a*; it may also be adapted to detect the rotation of the abrasive wheels per se. Besides the optical method just described above, magnetic and various other means may be employed to detect the amount of rotation of the abrasive wheels.

(C) Display Section and Input Section

Figure 5:
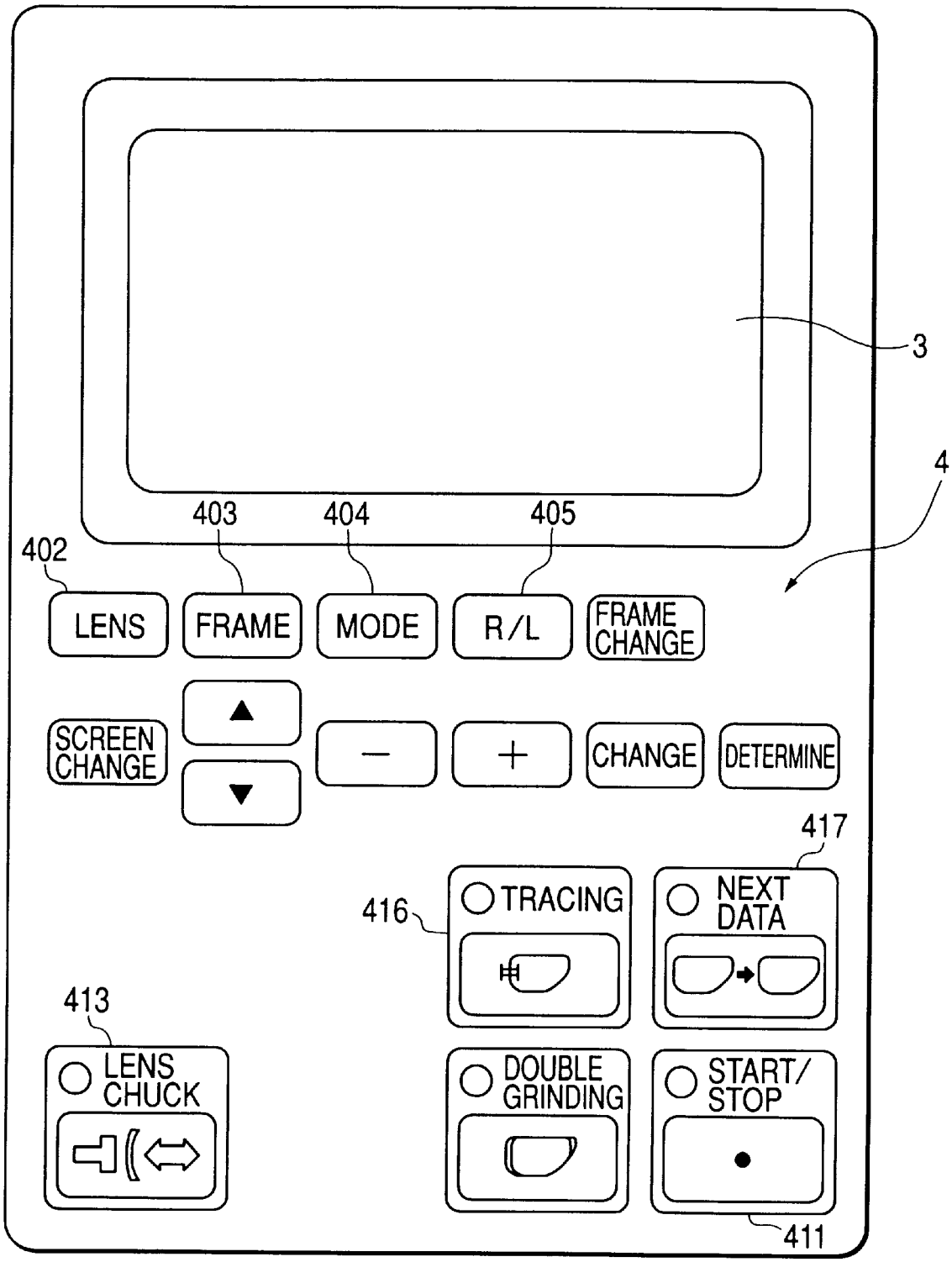
FIG. 5 is a diagram showing the outer appearance of the display and input sections of the grinding machine.

FIG. 5 is a diagram showing the outer appearance of the display section 3 and the input section 4, which are formed into an integral unit. The input section 4 includes various setting switches such as a lens switch 402 for distinguishing either of plastics and glass as the constituent material of the lens to be processed, a frame switch 403 for distinguishing between resins and metals as the constituent material of the frame, a mode switch 404 for selecting the mode of lens processing to be performed (whether it is tapered edge (bevel) processing or plane processing), a R/L switch 405 for determining whether the lens to be processed is for use on the right eye or the left eye, a START/STOP switch 411 for starting or stopping the lens processing operation, a switch 413 for opening or closing the lens chucks, a tracing switch 416 for giving directions on the eyeglass frame and template tracing, and a next-data switch 417 for transferring the data measured with the eyeglass frame and template configuration measurement device 2.

(D) Electronic Control System for the Apparatus

Figure 6:
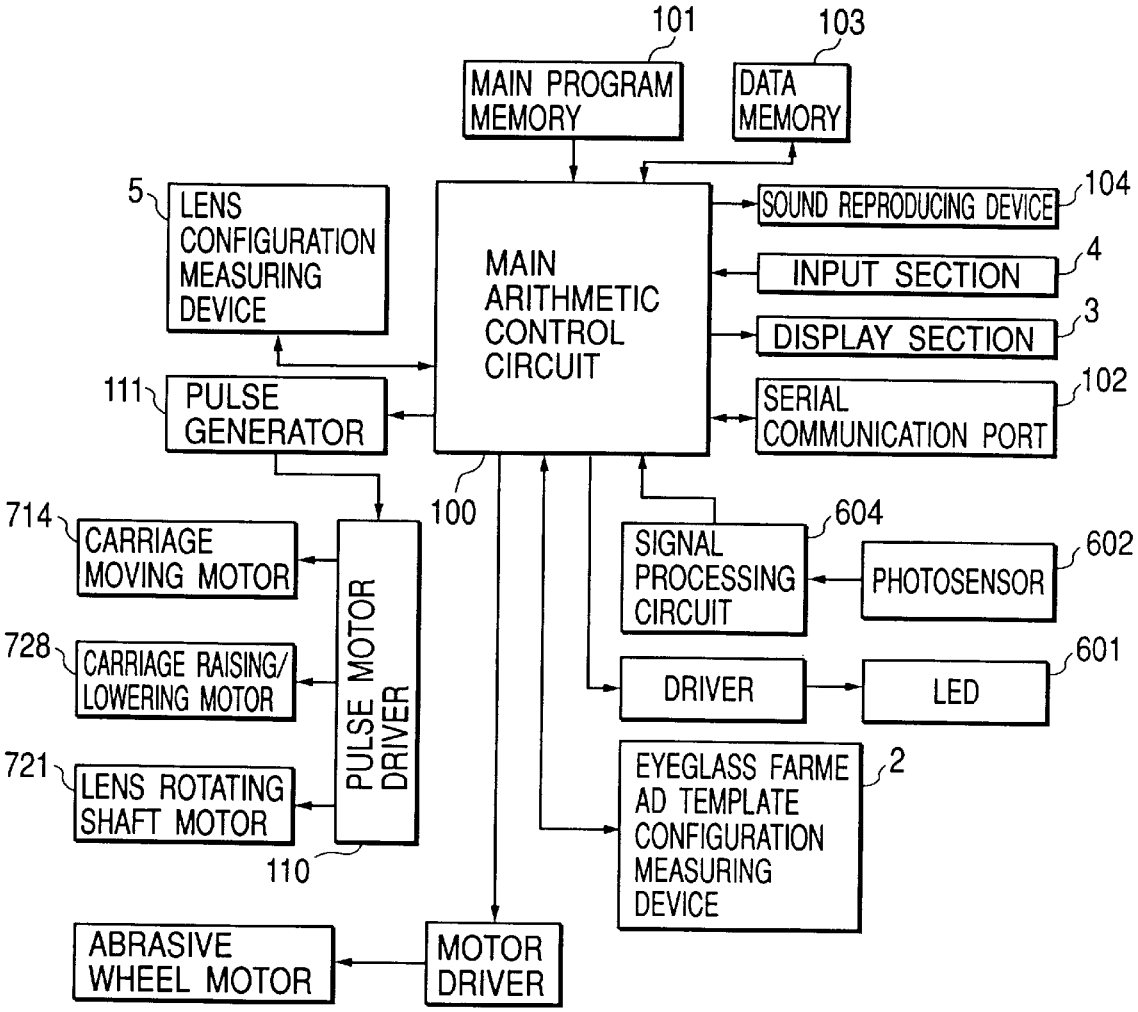
FIG. 6 shows the essential part of a block diagram of the electronic control system for the grinding machine.

FIG. 6 shows the essential part of the block diagram of the electronic control system for the eyeglass lens grinding machine of the invention. A main arithmetic control circuit 100 which is typically formed of a microprocessor and controlled by a sequence program stored in a main program memory 101. The main arithmetic control circuit 100 can exchange data with IC cards, eye examination devices and so forth via a serial communication port 102. The main arithmetic control circuit 100 also performs data exchange and communication with the eyeglass frame and template configuration measurement device 2. Data on the eyeglass frame configuration are stored in a data memory 103.

The display section 3, the input section 4 and the lens configuration measuring device 5 are connected to the main arithmetic control circuit 100. Signals of the results of measurement as detected with the lens configuration measuring device 5 are processed arithmetically in the main arithmetic control circuit 100 and the resulting data for lens measurements are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how may pulses are to be supplied at what frequency in Hz to the respective pulse motors to control their operation.

Figure 7:
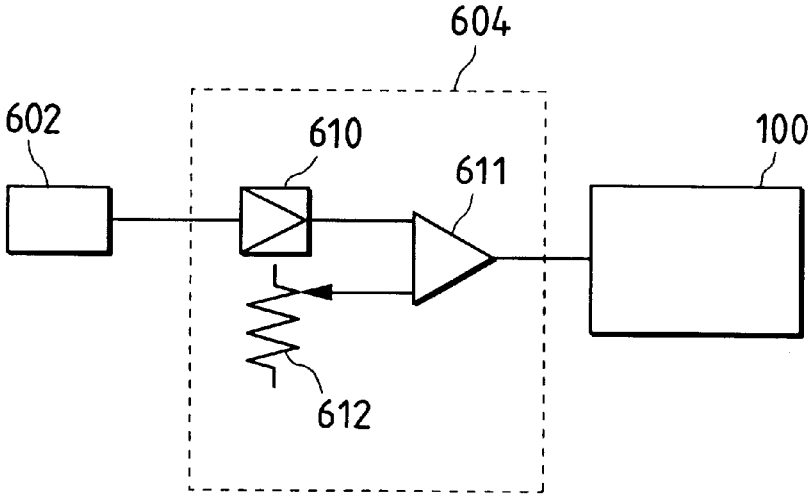
FIG. 7 shows a specific configuration of a signal processor circuit for use in detecting the rotation of abrasive wheels.

Voltage signals from the photosensor 602 are processed with a signal processor circuit 604 and fed into the main arithmetic control circuit 100. As shown specifically in FIG. 7, the signal processor circuit 604 comprises an amplifier 610, a comparator 611 and a variable resistor 612. The voltage signal produced from the photosensor 602 is amplified by the amplifier 610 and fed into the comparator 611, which outputs a strobe signal when the signal from the photosensor 2 reaches the level of a voltage signal supplied from the variable resistor 612. The output strobe signal is a detection signal for the rotation of the abrasive wheels, which is fed into the main arithmetic control circuit 100.

We now describe the operation of the eyeglass lens grinding machine of the invention, chiefly with respect to a rough grinding mode. On the basis of the data for frame configuration measured with the eyeglass frame and template configuration measuring device 2, the machine performs arithmetic operations for correction in processing (i.e., the correction of the diameter of abrasive wheels) (see, for example, U.S. Pat. No. 5,347,762) so as to obtain data for lens processing and on the basis-of this data, the machine will perform the following rough grinding operation.

First, the abrasive wheel group 60 is rotated and, at the same time, the pulse motor 728 is run to vary the Y-axis. The amount by which the Y-axis is to be varied is determined on the basis of the data for lens processing and the main arithmetic control circuit 100 drives the pulse motor 728 such that the lens will be ground to have the desired profile (configuration). The lens is ground with the abrasive wheel onto which it is pressed under the resilient force of the spring 731. The main arithmetic control circuit 100 first supplies the pulse motor 728 with a Y-axis varying signal at the reference position for rotation and then drives the pulse motor 721 to rotate the lens through a small angle. Simultaneously and in synchronism with this action, the main arithmetic control circuit 100 supplies the pulse motor 728 with an operation signal which varies the Y-axis on the basis of the data for lens processing. Thus, by rotating the lens through small angles on the basis of the data for lens processing, the main arithmetic control circuit 100 controls the movement of the Y-axis continually in succession until the lens is ground to have the intended profile (configuration).

Throughout the lens processing operation described above, the main arithmetic control circuit 100 monitors the number of rotations of the abrasive wheels, or the rotational speed of the abrasive wheels as detected by the combination of the photosensor 602 and the signal processor circuit 604. The number of rotations of the abrasive wheels is detected by counting the number per unit time of strobe signals that are produced from the comparator 611. As the amount of the lens to be ground increases, an increased grinding load is exerted on the abrasive wheels, and thus the number of their rotations decreases. If the number of their rotations per unit time (i.e., the rotational speed of the abrasive wheels) drops below the normal number of rotations (i.e., the reference number of rotations) to a specified level (say, 70% of the reference number of rotations), the rotation of the abrasive wheels by means of the pulse motor 721 is brought to a temporary stop (or, alternatively, the rotational speed of the lens is reduced). When the lens stops rotating, less of the lens is ground and the grinding load decreases, whereupon the number of rotations of the abrasive wheels per unit time starts to restore. When the number of rotations of the abrasive wheels has restored to the threshold level for the start of lens rotation, the lens restarts to rotate for processing.

If desired, on the moment the lens stops rotating, the movement of the Y-axis may be controlled by the pulse motor 728 to inactivate the urging force of the spring 731 and this is effective in causing the rotation of the abrasive wheels to revert to the threshold level for the start of lens rotation more quickly.

Thus, in accordance with the invention, the number of rotations of the abrasive wheels is monitored (alternatively, the grinding load may be monitored directly) so as to control the rotation of the lens in a variable manner, thereby ensuring that the grinding load on the abrasive wheels will not increase so much as to cause the abrasive wheels to stop rotating during lens processing. As a result, excessive flow of abnormal currents through the AC motor 65 can be effectively prevented to protect the machine against thermal damage and other troubles while ensuring that no undesirable burden will be imposed on the power supply equipment. In addition, the abrasive wheels (or the rotational shaft 61*a*) are constantly checked for the state of their rotation to thereby ensure the detection of any abnormal rotations of the abrasive wheels which will occur in certain cases such as where there occurs something abnormal in the belt 64 transmitting the rotation of the AC motor 65 or where vapor condensation on the machine or other phenomena cause a slip between the pulley 63 and the belt 64. If, after the lens stops rotating, the number of rotations of the abrasive wheels does not return to the threshold level for the start of lens rotation upon the lapse of a specified time period, a STOP signal is issued to stop the rotational driving of the AC motor 65 and, at the same time, an ERROR or other suitable information to indicate the occurrence of something abnormal is displayed in the display section 3. This procedure not only prevents the machine from being damaged but also notifies the operator of the need to check it for any abnormal parts.

The above-described monitoring of the state of rotation of the abrasive wheels, as combined with the control of lens rotation offers the added advantage that the lens can be ground in amounts that have a good balance with the grinding load and, hence, even if high-performance abrasive wheels having great grinding power or if the rotational speed of the AC motor 65 is increased, these approaches can be effectively utilized to achieve results that would be obtained if their grinding capabilities were exploited to near-limit levels. As a result, the lens processing time can be shortened.

While the eyeglass lens grinding machine of the invention has been described above with particular reference to rough grinding, it should be noted that in finishing and other operations, the lens rotation and, hence, the amount of the lens to be ground is controlled on the basis of the information on the rotation of abrasives which has been obtained from the abrasive wheel rotation detecting section 600.

As described on the foregoing pages, the present invention allows the grinding capability of abrasive wheels to be effectively utilized to thereby accomplish efficient grinding operations.

What is claimed is:

1. An eyeglass lens grinding machine comprising:

lens rotating means for holding and rotating a lens to be processed;

abrasive wheel rotating means for rotating an abrasive wheel for grinding the lens on its own axis;

biasing means for generating a pressure by biasing the lens rotating means toward the abrasive wheel rotating means during lens processing;

abrasive wheel rotational state detecting means for detecting a state of rotation of the abrasive wheel caused by said abrasive wheel rotating means; and rotation control means for variably changing the rotation of said lens rotating means on the basis of the result detected by said abrasive wheel rotational state detecting means, wherein when the abrasive wheel rotational state detecting means indicates that the rotational speed of the abrasive wheel is not more than a predetermined level, the rotation control means stops the rotation of the lens rotating means until the rotational speed of the abrasive wheel is more than said predetermined level.

2. The eyeglass lens grinding machine according to claim 1, wherein said abrasive wheel rotational state detecting means has photodetector means for projecting light onto the rotating abrasive wheel or its shaft and for detecting reflected light therefrom.

3. The eyeglass lens grinding machine according to claim 1, wherein said abrasive wheel rotational state detecting means includes load detecting means for detecting a grinding load, and wherein said rotation control means includes:

command means for issuing a command to either stop down the rotation of said lens rotating means if the load detected by said load detecting means exceeds a given reference value; and return command means for issuing a command to revert the rotation of said lens rotating means to a steady state if said load is less than the given reference value.

4. The eyeglass lens grinding machine according to claim 1, further comprising:

rotational speed setting means for variably setting a rotational speed of said abrasive wheel rotating means.

5. The eyeglass lens grinding machine according to claim 1, wherein said abrasive wheel rotational state detecting means includes rotational speed detecting means for detecting the rotational speed of the abrasive wheel or its shaft per unit time, and wherein said rotation control means includes:

stop command means for issuing a command to stop the rotation of said lens rotating means if the rotational speed of the abrasive wheel has become lower than a given rotational speed which has been preset as relative to a reference rotational speed; and restart command means for issuing a command to restart the rotation of said lens rotating means if the rotational speed of the abrasive wheel has become higher than the given rotational speed.

6. The eyeglass lens grinding machine according to claim 1, wherein said abrasive wheel rotational state detecting means includes the number of rotations detecting means for detecting the number of rotations of the abrasive wheel or its shaft per unit time, and wherein said rotation control means includes:

stop command means for issuing a command to stop the rotation of said lens rotating means if the number of rotations of the abrasive wheel has become lower than a given number of rotations which has been preset as relative to a reference number of rotations; and restart command means for issuing a command to restart the rotation of said lens rotating means if the number of rotations of the abrasive wheel has become higher than the given number of rotations.

7. The eyeglass lens grinding machine according to claim 1, further comprising means for releasing the bias applied by the biasing means when the rotational speed of the abrasive wheel is not more than the predetermined level and the rotation of the lens rotation means is stopped.

8. The eyeglass lens grinding machine according to claim 1, further comprising display means for indicating an abnormal occurrence when the rotational speed of the abrasive wheel is not more than said predetermined level within a predetermined time period after the rotation of the lens rotation means was stopped.

* * * * *